US005881709A

United States Patent [19]

Daoust

[11] Patent Number: 5,881,709

[45] Date of Patent: Mar. 16, 1999

[54] ALCOHOL FUEL BURNER

[76] Inventor: Gilles Daoust, 6575 Des Perrons, Auteuil, Laval, Quebec, Canada, H7L 1K5

[21] Appl. No.: 773,983

[22] Filed: Dec. 26, 1996

[51] Int. Cl.[6] ..... F24C 5/02

[52] U.S. Cl. ..... 126/44; 126/50; 126/43; 126/9 B; 126/38

[58] Field of Search ..... 126/43, 44, 50, 126/40, 26, 9 R, 9 B, 38; 431/152

[56] References Cited

U.S. PATENT DOCUMENTS

| | | | |
|---|---|---|---|
| 1,050,113 | 1/1913 | Eichelkraut | 126/256 |
| 1,421,284 | 6/1922 | Meikle | 126/43 |
| 1,453,519 | 5/1923 | Rawls | 431/341 |
| 2,414,490 | 1/1947 | Speaker | 126/43 |
| 3,371,659 | 3/1968 | Paspalas | 126/43 |
| 3,606,609 | 9/1971 | Lipper et al. | 431/152 |

*Primary Examiner*—Larry Jones

[57] ABSTRACT

An alcohol fuel burner which comprises a fuel container having a base and a side wall, a cover for the upper portion of the container, the covering having a plurality of inlet apertures as well as a central aperture, draft control means to control the amount of air permitted through the air inlet apertures, an inner chimney extending upwardly from the centrally located aperture and an outer chimney extending upwardly from the fuel container with the outer chimney being spaced from the inner chimney. The device permits efficient burning of the fuel in the container.

10 Claims, 3 Drawing Sheets

ALCOHOL FUEL BURNER

FIELD OF THE INVENTION

The present invention relates to a fuel burner of the type used for cooking food or heating liquids in pots or pans.

BACKGROUND OF THE INVENTION

The use of small alcohol fuel burners for heating pots and/or pans containing food is well known in the art. Typically, these types of alcohol burners are widely used for heating fondu types of foods. There are also occasionally used in other situations where heating is required.

While these devices are well known and generally function satisfactorily, it is desirable to have a device which minimizes turbulence about the flame.

SUMMARY OF THE INVENTION

It is an object of the present invention to provide a burner of the alcohol fueled type wherein a relatively steady rate of burn of the fuel can be achieved despite air currents and the like.

According to one aspect of the present invention there is provided a burner device comprising a fuel container having a base and a side wall, a cover member extending over the side wall, the cover having an upwardly and inwardly tapering cover side wall to define a main upper centrally located aperture, a plurality of air inlet apertures in the cover side wall to provide gaseous communication between an upper interior portion of the container and the exterior thereof, moveable draft control means to control the amount of air passing through the air inlet apertures, an inner chimney extending upwardly from the centrally located aperture, and an outer chimney extending upwardly from the cover and being spaced from the inner chimney, air inlet apertures being provided in the outer chimney.

In a further aspect of the present invention there is provided a combination comprising a fuel container having a base and a side wall, a cover member extending over the side wall, the cover having an upwardly and inwardly tapering cover side wall to define a main upper centrally located aperture, a plurality of air inlet apertures in the cover side wall to provide gaseous communication between an upper interior portion of the container and exterior thereof, moveable draft control means to control the amount of air passing through the air inlet apertures, an inner chimney extending upwardly from the centrally located aperture, an outer chimney extending upwardly from the cover and being spaced from the inner chimney, the outer chimney having air inlet apertures formed therein, and a cap member having a generally cylindrical configuration, the cap member being sized to fit over the inner chimney.

In greater detail, the burner device of the present invention will be referred to as being that type which burns alcohol as is typically used for the heating of fondues and the like. However, it will be understood that other fuels may be used as appropriate.

The material used for the burner may be selected among those known in the art. Typically, the burners may be constructed of a suitable metallic material such as a stainless steel and the like. It will be further understood that the interior of the fuel container may be filled with an absorbent material such as is well known in the art.

BRIEF DESCRIPTION OF THE DRAWINGS

Having thus generally described the invention, reference will be made to the accompanying drawings illustrating an embodiment thereof, in which.

DETAILED DESCRIPTION

Figure 1:
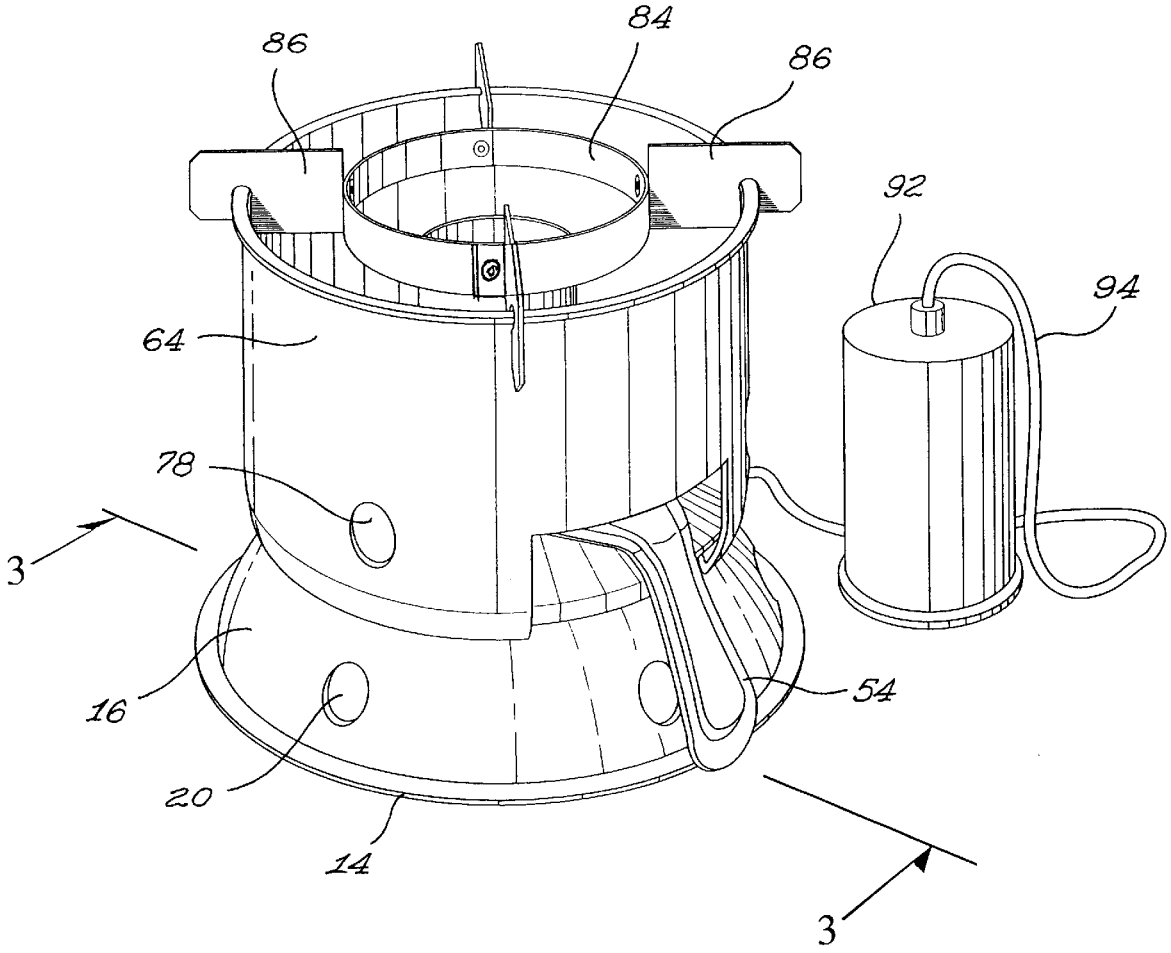
FIG. 1 is a perspective view of an alcohol fuel burner according to the present invention.

Referring to the drawings in greater detail and by reference characters thereto, there is illustrated an alcohol fuel heating device according to the present invention and which device is generally designated by reference numeral 10.

Alcohol fuel heating device 10 includes a base stand designated by reference numeral 12 and which base stand includes a side wall 16 terminating at its lower end in an outwardly extending lower flange 14. Lower flange 14 is adapted to form the base or seating surface for the device of the present invention.

At its upper end, wall 16 of base stand 12 terminates in an upper peripheral edge 18. A plurality of apertures 20 are provided in wall 16 for reasons which will become apparent hereinbelow.

There is provided an alcohol fuel container generally designated by reference numeral 24 and which forms the primary burn unit of the present invention. Alcohol fuel container 24 has a bottom wall 26 and a lower annular wall 28 which, as may be best seen in FIG. 3, merges arcuately with bottom wall 26 and extends upwardly therefrom and also flares slightly outwardly.

An upper cover generally designated by reference numeral 30 has an upper wall portion 34 having at its lower end a downwardly extending annular flange 32. Annular flange 32 is adapted to seat against an upper portion of the exterior surface of annular wall 28.

Located centrally of upper wall portion 34 is a central aperture 38 while formed within upper wall portion 34 are a plurality of smaller air inlet apertures 36.

A draft control member is generally designated by reference numeral 42 and is formed to have a generally frustroconical wall 44 terminating at its upper end in an inwardly extending flange 45. Flange 45 surrounds a central aperture 46 which is in general registry with central aperture 38 of cover 30. Similarly, there are provided a plurality of air inlet apertures 48 in wall 44 of draft control member 42 and which air inlet apertures 48 are arranged to be in general registry with apertures 36 formed in upper wall portion 34 of cover 30.

Figure 2:
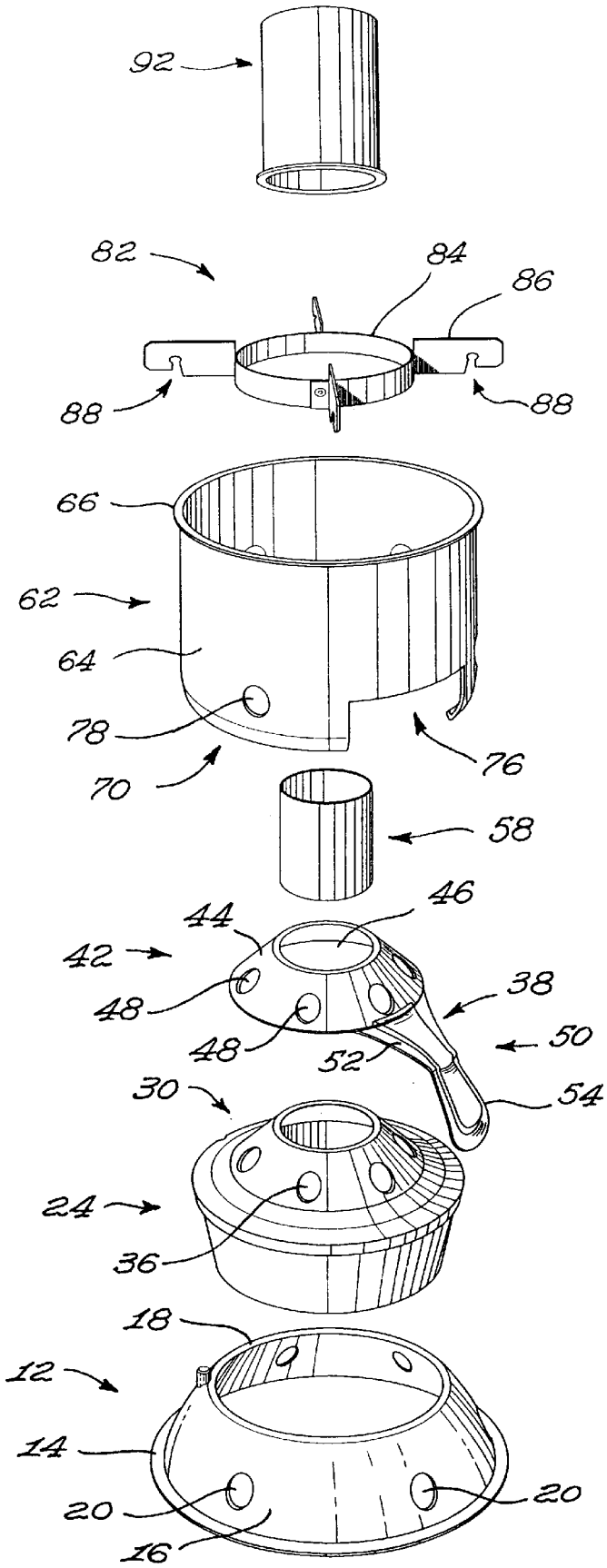
FIG. 2 is an exploded view thereof.

Draft control member 42 includes a handle generally designed by reference numeral 50 and which has a horizontal portion 52 and a downwardly angled portion 54. As may be best seen in FIG. 2, handle 50 may be formed so as to have a rib formed therein to add rigidity to its structure.

The present invention includes an inner tube or chimney generally designated by reference numeral 58 and which is formed to have a cylindrical configuration member. Inner tube or chimney 58 is sized to fit interiorly of flange 45 and to form a chimney in registry with apertures 46 and 38.

The present invention also includes an outer chimney which is generally designated by reference numeral 62 and which is formed to have an annular wall 64 terminating at an upper peripheral edge in an upper rim 66. At its lower edge, outer tube 62 terminates in a V-shaped portion generally designated by reference numeral 70. In this respect, V-shaped portion 70 has a first wall 72 merging arcuately with annular wall 64 and a second wall 74 extending inwardly and adapted to seat against downwardly extending flange 32 of cover 30.

Outer chimney 62 includes a cutout 76 which is assigned to permit the passage therethrough of horizontal portion 52 of handle 50 and to allow for movement of draft control member 42 so as to permit one to move into and out of registry apertures 36 and 48 to thereby control the amount of draft and thereby control the combustion within container 24. Outer chimney 62 includes a plurality of air inlet apertures 78 formed in the lower wall portion thereof.

There is also provided a support member generally designated by reference numeral 82 and which is configured to have an annular ring 84 with a plurality of outwardly extending extension 86. Each extension 86 includes a notch 88 shaped and sized to receive upper rim 66 of annular wall 64 such that support 82 may rest thereon.

There is also provided a cylinrically shaped cap member 92 which may be attached by means of a retaining cord 94. Cover 92 has a larger diameter than inner chimney 58 and may be used to place over inner chimney 58 to distinguish any flame and also may be used to measure the amount of fuel placed in container 24.

Figure 3:
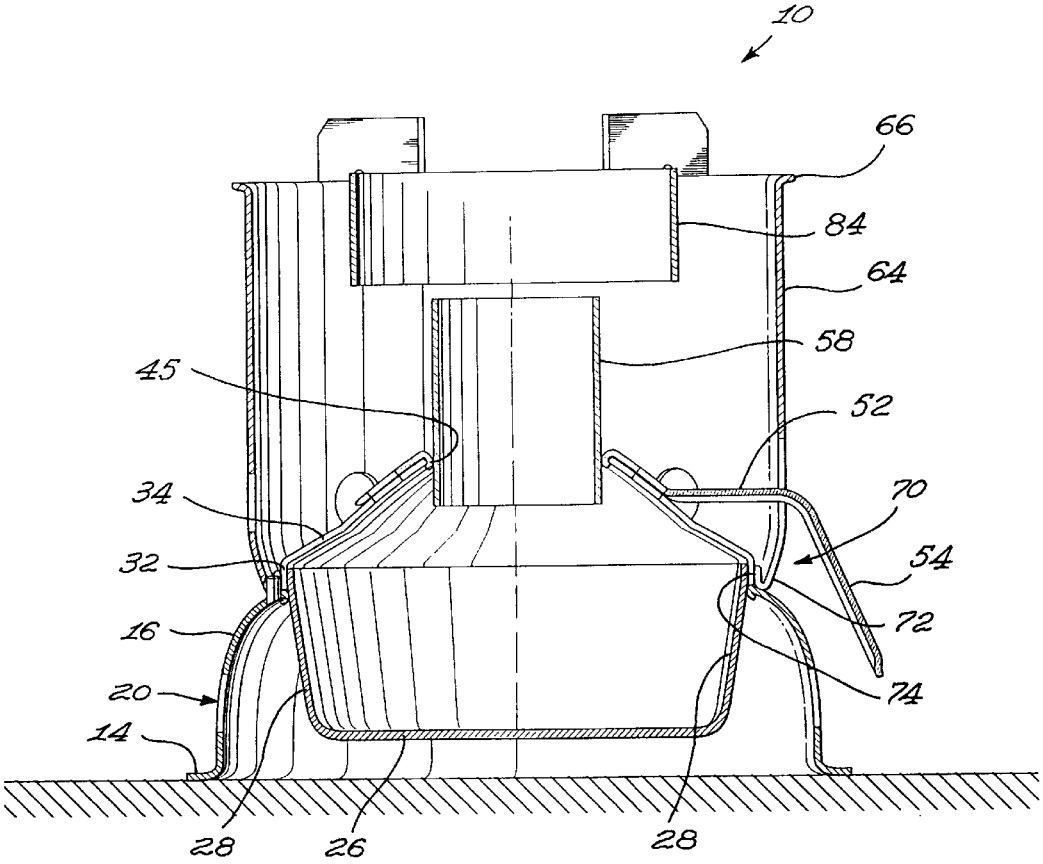
FIG. 3 is a sectional view taken along the lines 3—3 of FIG. 1.

As may be best seen in FIG. 3, the alcohol fuel burner device 10 of the present invention provides for an efficient way of utilizing alcohol as a fuel in a burner. The use of an outer chimney 64 permits the entry of air down along the inward wall of chimney 64 wherein V-shaped portion 70 substantially prevents turbulence as the air is fed into the interior of container 24 through air inlet apertures 48 and 36. Also, some of the air will be preheated by proximity to inner chimney 58 and thereby provide for a better insulation.

The provision of the chimneys minimizes flame turbulence and promotes a more consistent cleaner burn. It will be understood that the above described description is for purposes of illustration only and that changes and modifications may be made thereto without departing from the spirit and scope of the invention.

The embodiments of the invention in which an exclusive privilege or property is claimed are defined as follows:

1. A burner device comprising a fuel container having a base and a side wall, a cover member extending over said side wall, said cover having an upwardly and inwardly tapering cover side wall to define a main upper centrally located aperture, a plurality of air inlet apertures in said cover side wall to provide gaseous communication between an upper interior portion of said container and the exterior thereof, moveable draft control means to control the amount of air passing through said air inlet apertures, an inner chimney extending upwardly from said centrally located aperture, and an outer chimney extending upwardly from said cover and being spaced from said inner chimney, said outer chimney having a first lower end seated against said fuel container below said air inlet apertures in said cover side wall, a second upper end of said outer chimney terminating above said inner chimney, air inlet apertures being provided in said outer chimney.

2. The device of claim 1 wherein said draft control means comprises a moveable member mounted on top of said cover side wall, said moveable member having air inlet apertures moveable into and out of registry with said air inlet apertures in said cover side wall.

3. The device of claim 2 wherein said moveable member includes a handle, said outer chimney having a cutout therein to permit said handle to extend exteriorly thereof.

4. The device of claim 3 wherein said handle includes a first horizontal portion extending outward through said cutout in said outer chimney and a downwardly angled distal end portion.

5. The device of claim 1 further including a base adapted to receive and support said fuel container to maintain said fuel container in a spaced apart relationship from a substrate on which said base rests.

6. The device of claim 5 further including air inlet apertures in said base.

7. The device of claim 1 further including an upper support member, said support member extending across said outer chimney and being retained thereby.

8. The device of claim 7 wherein said upper support member comprises an annular ring having a plurality of elements extending outwardly therefrom, each of said elements having a notched lower portion, said notched lower portion being adapted to seat on an upper marginal edge of said outer chimney.

9. In combination, a burner comprising a fuel container having a base and a side wall, a cover member extending over said side wall, said cover having an upwardly and inwardly tapering cover side wall to define a main upper centrally located aperture, a plurality of air inlet apertures in said cover side wall to provide gaseous communication between an upper interior portion of said container and exterior thereof, moveable draft control means to control the amount of air passing through said air inlet apertures, an inner chimney extending upwardly from said centrally located aperture, an outer chimney extending upwardly from said cover and being spaced from said inner chimney, said outer chimney having a first lower end seated against said fuel container below said air inlet apertures in said cover side wall, a second upper end of said outer chimney terminating above said inner chimney, said outer chimney having air inlet apertures formed therein, and a cap member having a generally cylindrical configuration, said cap member being sized to fit over said inner chimney.

10. The combination of claim 9 further including retention means associated with said cap member.

* * * * *